US006370910B1

(12) United States Patent
Grootjans et al.

(10) Patent No.: US 6,370,910 B1
(45) Date of Patent: Apr. 16, 2002

(54) LIQUEFYING A STREAM ENRICHED IN METHANE

(75) Inventors: Hendrik Frans Grootjans; Robert Klein Nagelvoort; Kornelis Jan Vink, all of The Hague (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/700,867

(22) PCT Filed: May 20, 1999

(86) PCT No.: PCT/EP99/03584

§ 371 Date: Nov. 20, 2000

§ 102(e) Date: Nov. 20, 2000

(87) PCT Pub. No.: WO99/60316

PCT Pub. Date: Nov. 25, 1999

(51) Int. Cl.[7] ..... F25J 1/00
(52) U.S. Cl. ..... 62/613; 62/619
(58) Field of Search ..... 62/613, 619

(56) References Cited

U.S. PATENT DOCUMENTS 4,065,278 A * 12/1977 Newton et al. ..... 62/613
4,504,296 A * 3/1985 Newton et al. ..... 62/613
4,548,629 A * 10/1985 Chiu ..... 62/613

FOREIGN PATENT DOCUMENTS

EP 0 723 125 A2 * 7/1996
FR 2 281 550 * 3/1976

* cited by examiner

*Primary Examiner*—Ronald Capossela

(57) ABSTRACT

Liquefying a stream enriched in methane comprising a) supplying a natural gas stream to scrub column, removing in the scrub column heavier hydrocarbons from the natural gas stream to obtain a gaseous overhead stream withdrawn from the top of the scrub column, partly condensing the gaseous overhead stream and removing from it a condensate stream, which is returned to the upper part of the scrub column as reflux; b) liquefying the stream enriched in methane in a tube arranged in a main heat exchanger by indirect heat exchange with a multicomponent refrigerant evaporating at low refrigerant withdrawn from the shell side of the main heat exchanger and partly condensing it at an elevated refrigerant pressure, and c) compressing the multicomponent refrigerant pressure in a tube arranged in an auxiliary heat exchanger by indirect heat exchange with an auxiliary multicomponent refrigerant evaporating at low auxiliary refrigerant pressure to obtain multicomponent refrigerant for use in step b), wherein partly condensing the gaseous overhead stream is done in a tube arranged in the auxiliary heat exchanger.

4 Claims, 2 Drawing Sheets

LIQUEFYING A STREAM ENRICHED IN METHANE

Figure 1:
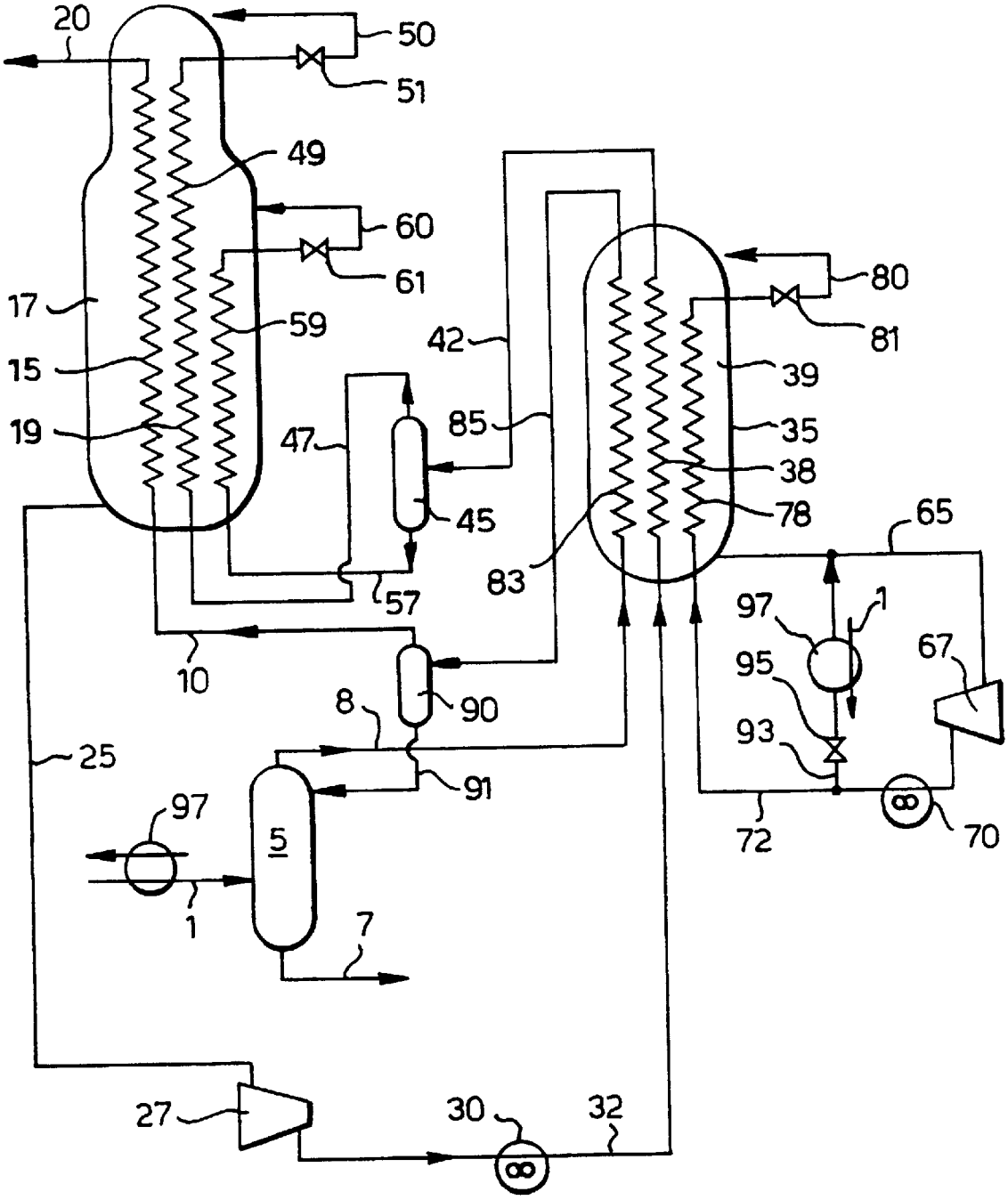

The present invention relates to a method of liquefying a stream that is enriched in methane. This stream is obtained from natural gas, and the product obtained by the method is referred to as liquefied natural gas (LNG).

In the article 'Liquefaction cycle developments' by R. Klein Nagelvoort, I Poll and A J Ooms, published in the proceedings of the 9th LNG International Conference, Nice, France, 17–20 October 1989 such a method is described.

The known method of liquefying a stream enriched in methane comprises the steps of:

a) supplying a natural gas stream at elevated pressure to a scrub column, removing in the scrub column heavier hydrocarbons from the natural gas stream which are withdrawn from the bottom of the scrub column to obtain a gaseous overhead stream withdrawn from the top of the scrub column, partly condensing the gaseous over head stream and removing from it a condensate stream to obtain the stream enriched in methane at elevated pressure;

b) liquefying the stream enriched in methane at elevated pressure in a tube arranged in a main heat exchanger by indirect heat exchange with a multicomponent refrigerant evaporating at low refrigerant pressure in the shell side of the main heat exchanger; and c) compressing the multicomponent refrigerant withdrawn from the shell side of the main heat exchanger and partly condensing it at elevated refrigerant pressure in a tube arranged in an auxiliary heat exchanger by indirect heat exchange with an auxiliary multicomponent refrigerant evaporating at low auxiliary refrigerant pressure in the shell side of the auxiliary heat exchanger to obtain multicomponent refrigerant for use in step b).

In the scrub column the gas stream is contacted with liquid reflux, which has a lower temperature so as to further cool the gas stream. As a result heavier hydrocarbons of the gas stream are condensed and the formed liquid is collected in the bottom of the scrub column from where it is withdrawn.

In the known method, the liquid heavier hydrocarbons withdrawn from the bottom of the scrub column and the condensate stream from the gaseous overhead stream are passed to a fractionation unit to be partially condensed. From the fractionation column a stream is removed which is used as reflux in the scrub column.

Prior to supplying the natural gas stream in step a) to the scrub column, it is cooled. The temperature of the reflux stream should be significantly lower than that of the natural gas stream supplied to the scrub column. This requirement sets a lower limit for the temperature of the natural gas stream supplied to the scrub column.

In the known method, the natural gas stream is cooled in a tube arranged in the auxiliary heat exchanger before it is introduced into the scrub column. Thus the temperature of the cold end of the auxiliary heat exchanger is limited by the temperature of the reflux stream. Thus more heat has to be extracted in the main heat exchanger to liquefy the stream enriched in methane.

It is an object of the present invention to allow a lower temperature at the cold end of the auxiliary heat exchanger so that the amount of heat that is to be extracted in order to liquefy the stream enriched in methane is reduced.

To this end the method of liquefying a stream enriched in methane according to the present invention is characterized in that partly condensing the gaseous overhead stream is done in a tube arranged in the auxiliary heat exchanger.

In this may the temperature of the cold end of the auxiliary heat exchanger can be selected as low as practicable.

In the known method, the temperture of the multicomponent refrigerant withdrawn from the cold end of the auxiliary heat exchanger was also limited by the temperature of the reflux. An advantage of the method of the present invention is that this limitation has been removed. Consequently a lower circulation rate of the multicomponent refrigerant is required.

Figure 2:
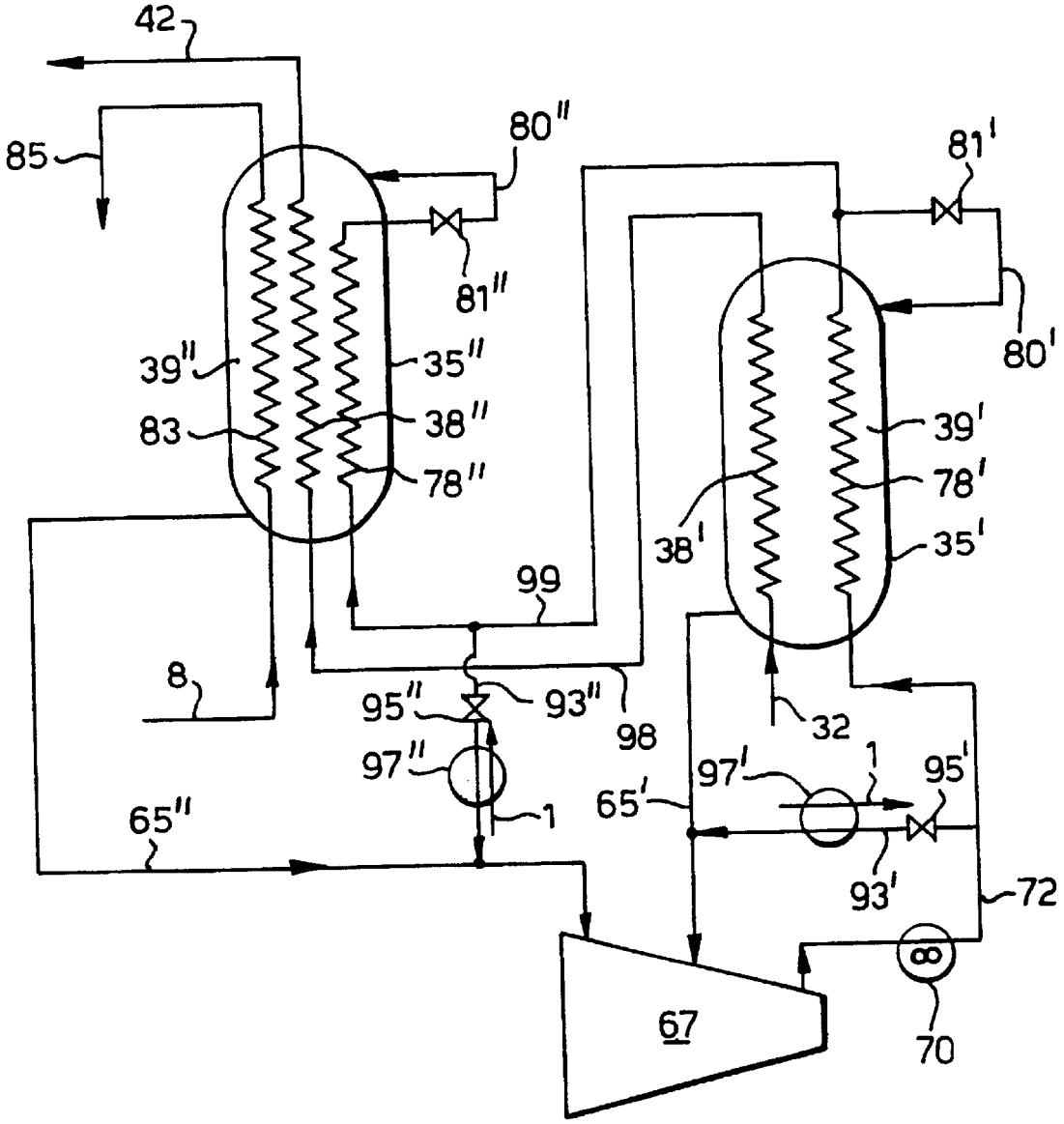

The invention will now be described by way of example in more detail with reference to the accompanying drawings, wherein FIG. 1 shows schematically a flow scheme of the plant in which the method of the invention is carried out, and FIG. 2 shows an alternative way of partly condensing the multicomponent refrigerant.

In the method of the present invention a natural gas stream 1 is supplied at elevated pressure to a scrub column 5. In which scrub column 5 hydrocarbons heavier than methane are removed from the natural gas stream, which heavier hydrocarbons are withdrawn from the bottom of the scrub column 5 through conduit 7. In this way a gaseous overhead stream is obtained which has a higher methane concentration than the natural gas, this gaseous overhead stream is withdrawn from the top of the scrub column 5 through conduit 8.

The gaseous overhead stream is partly condensed, and from it a condensate stream is removed to obtain a stream enriched in methane at elevated pressure that is passed through conduit 10 to a first tube 15 arranged in a main heat exchanger 17 in which the stream is liquefied. We will first discuss the liquefaction in more detail before partly condensing the gaseous overhead stream is discussed.

Liquefying the stream enriched in methane at elevated pressure is done in the first tube 15 arranged in the main heat exchanger 17 by indirect heat exchange with a multicomponent refrigerant evaporating at low refrigerant pressure in the shell side 19 of the main heat exchanger 15. Liquefied gas is removed at elevated pressure from the main heat exchanger 17 through conduit 20 for further treatment (not shown).

The evaporated multicomponent refrigerant is withdrawn from warm end of the shell side 19 of the main heat exchanger 15 through conduit 25. In compressor 27 the multicomponent refrigerant is compressed to elevated refrigerant pressure. Heat of compression is removed using at air cooler 30. The multicomponent refrigerant is passed through conduit 32 to an auxiliary heat exchanger 35. In a first tube 38 of the auxiliary heat exchanger 35, the multicomponent refrigerant is partly condensed at elevated refrigerant pressure by indirect heat exchange with an auxiliary multicomponent refrigerant evaporating at low auxiliary refrigerant pressure in the shell side 39 of the auxiliary heat exchanger 35 to obtain multicomponent refrigerant which is passed to the main heat exchanger 17.

The multicomponent refrigerant is passed from the first tube 38 through a conduit 42 to a separator 45, where it is separated into a gaseous overhead stream and a liquid bottom stream. The gaseous overhead stream is passed through a conduit 47 to a second tube 49 arranged in the main heat exchanger 17, where the gaseous overhead stream is cooled, liquefied and sub-cooled at elevated refrigerant pressure. The liquefied and sub-cooled gaseous overhead stream is passed through conduit 50 provided with an expansion device in the form of an expansion valve 51 to the cold end of the shell side 19 of the main heat exchanger 17 in which it is allowed to evaporated at low refrigerant pressure. The liquid bottom stream is passed through a conduit 57 to a third tube 59 arranged in the main heat exchanger 17, where the liquid bottom stream is cooled at elevated refrigerated pressure. The cooled liquefied bottom stream is passed through conduit 60 provided with an expansion device in the form of expansion valve 61 to the middle of the shell side 19 of the main heat exchanger 17 in which it is allowed to evaporate at low refrigerated pressure. The evaporating multicomponent refrigerant does not only extract heat from the fluid passing through the first tube 15 in order to liquefy it, but also from the refrigerant passing through the second and the third tube 49 and 59.

The auxiliary multicomponent refrigerant evaporated at low auxiliary refrigerant pressure in the shell side 39 of the auxiliary heat exchanger 35 is removed therefrom through conduit 65. In compressed 67 the auxiliary multicomponent refrigerant is compressed to elevated auxiliary refrigerant pressure. Heat of compression is removed using an air cooler 70. The auxiliary multicomponent refrigerant is passed through conduit 72 to a second tube 78 arranged in the auxiliary heat exchanger 35 in which it is cooled. The cooled auxiliary multicomponent refrigerant is passed through conduit 80 provided with an expansion device in the form of expansion valve 81 to the cold end of the shell side 39 of the auxiliary heat exchanger 35 in which it is allowed to evaporate at low auxiliary refrigerant pressure.

Having discussed the liquefaction cycle in more detail we will now discuss how the gaseous overhead stream withdrawn through conduit 8 from the top of the scrub column 5 is partly condensed.

The gaseous overhead stream is supplied through conduit 8 to a third tube 83 arranged in the auxiliary heat exchanger 35. In this third tube 83 the gaseous overhead stream is partly condensed. The partly condensed gaseous overhead stream is removed from the third tube 83 and passed via conduit 85 to separator 90. In separator 90 a condensate stream is removed to obtain the stream enriched in methane at elevated pressure that is passed through the conduit 10 to the first tube 15 arranged in the main heat exchanger 17. The condensate stream is returned through conduit 91 to the upper part of the scrub column 5 as reflux.

The method of the present invention differs from the known method in that in the known method the natural gas stream was cooled in the auxiliary heat exchanger before it was supplied to the scrub column. In the known method reflux was obtained from a fractionation unit, and the temperature of this reflux determines the upper limit of the temperature of the cooled natural gas as supplied to the scrub column.

The temperature to which the natural gas can be cooled in the known method was about −22° C. in order that it is above the reflux temperature. This means that the lowest temperature that can be obtained at the cold end of the auxiliary heat exchanger is also −22° C. This is then as well the temperature of the partly condensed multicomponent refrigerant. In addition, cooling the natural gas to −22° C. upstream of the scrub column also implies that the process gets less and less efficient, because of the cold removed with the liquid heavier hydrocarbons withdrawn from the bottom of the scrub column.

In the method of the invention, however, the gaseous overhead stream withdrawn through conduit 8 from the top of the scrub column 5 is partly condensed to a much lower temperature of about −50° C., and that can be done because it provides the reflux to the scrub column 50.

As a result the temperature at the cold end of the auxiliary heat exchanger 35 is much lower than in the known method. Thus the temperature to which the multicomponent refrigerant is cooled is much lower and this results in a lower circulation rate of the multicomponent refrigerant.

Suitably, the natural gas stream is pre-cooled and dried before it enters into the scrub column 5. Pre-cooling is suitably effected by indirect heat exchange with a bleed stream from the auxiliary multicomponent refrigerant passing through conduit 72 downstream of the air cooler 70. To this end the auxiliary multicomponent refrigerant is passed through conduit 93 provided with expansion valve 95 to a heat exchanger 97 arranged in conduit 1. Please note that for the sake of simplicity, we have shown the heat exchanger 97 twice, at first in the conduit 1 and secondly in the circuit between the conduits 72 and 65. However, it is the same heat exchanger.

Suitably, the multicomponent refrigerant is partly condensed in two stages. This embodiment of the present invention will be described with reference of FIG. 2.

The auxiliary heat exchanger of FIG. 2 comprises a first auxiliary heat exchanger 35' and a second auxiliary heat exchanger 35".

The multicomponent refrigerant is passed through conduit 32 to the first auxiliary heat exchanger 35', In the first tube 38' of the first auxiliary heat exchanger 35', the multicomponent refrigerant is cooled at elevated refrigerant pressure by indirect heat exchange with an auxiliary multicomponent refrigerant evaporating at intermediate auxiliary refrigerant pressure in the shell side 39' of the first auxiliary heat exchanger 35'. Cooled multicomponent refrigerant is passed through connecting conduit 98 to the second auxiliary heat exchanger 35".

In the first tube 38" of the second auxiliary heat exchanger 35", the multicomponent refrigerant is partly condensed at elevated refrigerant pressure by indirect heat exchange with an auxiliary multicomponent refrigerant evaporating at low auxiliary refrigerant pressure in the shell side 39" of the second auxiliary heat exchanger 35" to obtain multicomponent refrigerant, which is passed through conduit 42 to the main heat exchanger (not shown in FIG. 2).

The auxiliary multicomponent refrigerant evaporated at intermediate auxiliary refrigerant pressure in the shell side 39' of the first auxiliary heat exchanger 35' is removed therefrom through conduit 65'. In this embodiment, compressor 67 is a two-stage compressor. In the second stage of the compressor 67, the auxiliary multicomponent refrigerant is compressed to elevated auxiliary refrigerant pressure. Heat of compression is removed using an air cooler 70. The auxiliary multicomponent refrigerant is passed through conduit 72 to a second tube 78' arranged in the first auxiliary heat exchanger 35' in which it is cooled. Part of the cooled auxiliary multicomponent refrigerant is passed through conduit 80' provided with an expansion device in the from of expansion valve 81' to the cold end of the shell side 39' of the first auxiliary heat exchanger 35' in which it is allowed to evaporator at intermediate auxiliary refrigerant pressure. The evaporating refrigerant extracts heat from the fluids flowing through the tubes 38' and 78'.

The remainder of the auxiliary multicomponent refrigerant is passed through connecting conduit 99 to a second tube 78" arranged in the second auxiliary heat exchanger 35" in which it is cooled. The cooled auxiliary multicomponent refrigerant is passed through conduit 80" provided with an expansion device in the form of expansion valve 81" to the cold end of the shell side 39" of the second auxiliary heat exchanger 35" in which it is allowed to evaporate at low auxiliary refrigerant pressure. The evaporating refrigerant extracts heat from the fluids flowing through the tubes 38"

and 78", and from the gaseous overhead stream withdrawn from the top of the scrub column 5 passing through the third tube 83.

Evaporated auxiliary multicomponent refrigerant at low auxiliary refrigerant pressure is removed through conduit 65". In the two-stage compressor 67 the auxiliary multicomponent refrigerant is compressed to elevated auxiliary refrigerant pressure.

Alternatively, the gaseous overhead stream withdrawn from the top of the scrub column 5 is partly condensed in both the first and the second auxiliary heat exchanger 35' and 35".

Suitably, the natural gas stream is pre-cooled and dried before it enters into the scrub column 5. Pre-cooling is suitably effected by indirect heat exchange with a bleed stream from the auxiliary multicomponent refrigerant passing through conduit 72 downstream of the air cooler 70. To this end the auxiliary multicomponent refrigerant is passed through conduit 93' provided with expansion valve 95' to a heat exchanger 97' arranged in conduit 1.

Further cooling of the natural gas stream can suitably be achieved by indirect heat exchange with a bleed stream from the auxiliary multicomponent refrigerant passing through connecting conduit 99. To this end the auxiliary multicomponent refrigerant is passed through conduit 93" provided with expansion valve 93" to a heat exchanger 97" arranged in conduit 1.

The air coolers 30 and 70 may be replaced by water coolers and, if required, they or the water coolers can be supplemented by heat exchangers in which a further coolant is used.

The expansion valve 61 can be replaced by an expansion turbine.

The auxiliary heat exchanger(s) 35, 35' and 35" can be spool wound or plate-fin heat exchangers.

What is claimed is:

1. Method of liquefying a stream enriched in methane comprising the steps of:

a) supplying a natural gas stream at elevated pressure to a scrub column, removing in the scrub column heavier hydrocarbons from the natural gas stream which are withdrawn from the bottom of the scrub column to obtain a gaseous overhead stream withdrawn from the top of the scrub column, partly condensing the gaseous overhead stream and removing from it a condensate stream, which is returned to the upper part of the scrub column as reflux to obtain the stream enriched in methane at elevated pressure;

b) liquefying the stream enriched in methane at elevated pressure in a tube arranged in a main heat exchanger by indirect heat exchange with a multicomponent refrigerant evaporating at low refrigerant pressure in the shell side of the main heat exchanger; and c) compressing the multicomponent refrigerant withdrawn from the shell side of the main heat exchanger and partly condensing it at elevated refrigerant pressure in a tube arranged in an auxiliary heat exchanger by indirect heat exchange with an auxiliary multicomponent refrigerant evaporating at low auxiliary refrigerant pressure in the shell side of the auxiliary heat exchange to obtain multicomponent refrigerant for use in step b), characterized in that partly condensing the gaseous overhead stream is done in a tube arranged in the auxiliary heat exchanger.

2. Method according to claim 1, wherein partly condensing the multicomponent refrigerant comprises cooling it at elevated refrigerant pressure in a tube arranged in a first auxiliary heat exchanger by indirect heat exchange with an auxiliary multicomponent refrigerant evaporating at intermediate auxiliary refrigerant pressure in the shell side of the first auxiliary heat exchanger and subsequently in a tube arranged in a second auxiliary heat exchanger by indirect heat exchange with an auxiliary multicomponent refrigerant evaporating at low auxiliary refrigerant pressure in the shell side of the second auxiliary heat exchanger, and wherein partly condensing the gaseous overhead stream is done by cooling the gaseous overhead in a tube arranged in the first and in the second auxiliary heat exchanger.

3. Method according to claim 2, wherein partly condensing the gaseous overhead stream is done in a tube arranged in the second auxiliary heat exchanger.

4. Method according to claim 1, wherein the natural gas stream is pre-cooled by indirect heat exchange with a bleed stream from the auxiliary multicomponent refrigerant.

* * * * *